US009133599B2

(12) United States Patent
Henning et al.

(10) Patent No.: US 9,133,599 B2
(45) Date of Patent: Sep. 15, 2015

(54) SKID DEVICE ATTACHABLE TO A BUCKET, BUCKET ASSEMBLY FOR MOVING MATERIAL, AND METHOD OF FORMING THE SKID DEVICE

(71) Applicant: R2 Manufacturing LLC, Point of Rocks, MD (US)

(72) Inventors: Ryan G. Henning, Leesburg, VA (US); Robert K Henning, Alden, NY (US)

(73) Assignee: R2 MANUFACTURING LLC, Point of Rocks, MD (US)

( * ) Notice: Subject to any disclaimer, the term of this patent is extended or adjusted under 35 U.S.C. 154(b) by 116 days.

(21) Appl. No.: 14/083,439

(22) Filed: Nov. 18, 2013

(65) Prior Publication Data

US 2015/0135561 A1 May 21, 2015

(51) Int. Cl.

| | |
|---|---|
| ***E02F 3/40*** | (2006.01) |
| ***E01H 5/06*** | (2006.01) |
| ***E02F 3/815*** | (2006.01) |

(52) U.S. Cl.

CPC ..... *E02F 3/401* (2013.01); *E01H 5/066* (2013.01); *E02F 3/8157* (2013.01)

(58) Field of Classification Search

CPC ..... E02F 3/40; E02F 3/401; E02F 3/8152; E02F 3/8157; E01H 5/06; E01H 5/066

USPC ..... 37/413, 448, 451

See application file for complete search history.

(56) References Cited

U.S. PATENT DOCUMENTS

| | | | | |
|---|---|---|---|---|
| 1,395,048 | A | 10/1921 | McKee | |
| 2,333,361 | A | 11/1943 | Churchill | |
| 2,593,025 | A * | 4/1952 | Hanson et al. | 280/28 |
| 2,840,936 | A * | 7/1958 | Rand | 172/777 |
| 2,884,720 | A | 5/1959 | Meyer et al. | |
| 3,281,972 | A | 11/1966 | Kerestes | |
| 4,043,061 | A * | 8/1977 | Heitman | 37/448 |
| 4,125,952 | A * | 11/1978 | Jennings | 37/405 |
| 4,182,057 | A * | 1/1980 | Klett et al. | 37/448 |
| 4,597,205 | A * | 7/1986 | Guest | 37/241 |
| 4,671,000 | A | 6/1987 | Kim | |
| 4,899,472 | A | 2/1990 | Winter | |
| 4,944,104 | A * | 7/1990 | Kowalczyk | 37/231 |
| 5,142,801 | A * | 9/1992 | Feller | 37/235 |
| 5,564,885 | A * | 10/1996 | Staben, Jr. | 414/724 |
| 5,638,617 | A | 6/1997 | Belanger et al. | |
| 6,240,662 | B1 * | 6/2001 | Borowiak | 37/404 |
| 6,718,662 | B1 * | 4/2004 | Schaff | 37/405 |
| 7,658,024 | B2 * | 2/2010 | Launder et al. | 37/454 |
| 8,281,505 | B2 | 10/2012 | Karlsson | |
| 2006/0288617 | A1 | 12/2006 | Colclough | |
| 2011/0315465 | A1 | 12/2011 | Henry | |

* cited by examiner

*Primary Examiner* — Jamie L McGowan

(74) *Attorney, Agent, or Firm* — Rossi, Kimms & McDowell LLP

(57) ABSTRACT

A bucket assembly and a skid device and a method of manufacturing thereof has a ski-shaped member and is configured to be attachable to a front end portion of a loading bucket. Two or more skid devices can be attached to the front edge portion of the bucket to enable the bucket to move materials on the ground. Each skid device has a mounting bracket configured to be attached to the front edge portion of the bucket and has a main fastening device for securing it to the bucket and a secondary securing device comprising a retaining member that maintains the skid device on the bucket when the main fastening device becomes loose or fails. The retaining member prevents the skid device from falling off the bucket and acts as an alarm by making rattling noise. Each skid device also allows mounting of an auxiliary member that enables the bucket to carrying items longer than the width of the bucket, such as logs or posts.

20 Claims, 6 Drawing Sheets

SKID DEVICE ATTACHABLE TO A BUCKET, BUCKET ASSEMBLY FOR MOVING MATERIAL, AND METHOD OF FORMING THE SKID DEVICE

BACKGROUND

Ski-like devices have been used to prevent ground damage, such as skids on a snow blower or snowplow. See for example, USPGP 2011/0315465 and U.S. Pat. Nos. 4,899,472 and 2,884,720. These references, however, disclose replaceable attachments for a dedicated snow blower or snowplow.

It would be desirable, for those who have a tractor or the like, to be able to use a front loader bucket (hereafter "bucket") to move material piled above the ground, including pavement typically constructed from concrete or cement to build a road or driveway, without damaging the ground. In this respect, USPGP 2006/0288617 (Colclough) discloses attachments for a loader bucket for moving snow and the problems associated with plowing snow with a bucket attached to a tractor, namely the bucket's cutting edge damaging the ground. In the Colclough reference, a plurality of bolt-on bucket-glide attachments can be bolted on the front side of the loader bucket.

There still remains a need for a device that can convert the loader bucket for multiple uses, including material on the ground, such as snow, and moving long objects, as some examples. The present development addresses this need.

SUMMARY OF THE INVENTION

One aspect of the present development is a skid device for a bucket having a stepped underside forming a lip portion extending across the width thereof at a rearward position from a front edge of the bucket.

The skid device can have a base member having an upper side and a lower side, a mount bracket attached to the upper side, a retainer member attached to the mount bracket, and a fastener device configured to secure the mount bracket to the bucket and function as a primary securing device.

The base member is configured to prevent the front edge portion of the bucket from contacting a ground surface. Specifically, the base member can have a leading end section, a middle section, and a trailing end section. Both the leading end section and the trailing end section can be angled relative to the middle section, which is substantially parallel to the underside of the front edge portion of the bucket upon securing the skid device to the bucket.

The skid device can further include a wear member attached to the lower side of the base member. Moreover, the wear member can be replaceably mounted to the base member. The wear plate can be configured complementary to the configuration of the base member to cover the leading end section, the middle section, and the trailing end section.

The mount bracket is configured to be mounted to a front edge portion of the bucket, with the retainer member and part of the base member positioned underneath the front edge portion of the bucket. Specifically, the mount bracket can have a base portion, an angled portion, and a leveled end portion. The base portion can be secured to the upper side of the middle section of the base member. The angled portion can extend rearwardly from a front side of the base portion at an angle. The leveled end portion can extend rearwardly from a rear side of the angled portion and parallel to the base portion. More specifically, the mount bracket can have a J-shape or fish-hook configuration.

The retainer member is configured to engage the lip portion when the fastener becomes loose and function as a secondary securing device, and also rattle against the underside and the lip portion of the bucket when the fastener becomes loose and function as an audio alarm. Specifically, the retainer member can be removably attached to a rear side of the base portion of the mount bracket. Both the retainer member and the base portion of the mount bracket can contact the underside of the bucket and serve as pressure points.

The skid device can further include an auxiliary member and the skid device can further include a reinforcement member attached to the angled portion of the mount bracket and the leading end section of the base member. The auxiliary member is removably attachable to a front portion of the reinforcement member. Specifically, one end of the auxiliary member can have a yoke configured to straddle the front portion of the reinforcement member, with a portion of the auxiliary member resting on an upper surface of the leading end portion of the base member.

Another aspect of the present development is a bucket assembly for moving material. The bucket assembly comprises the bucket having a stepped underside forming a lip portion extending across the width thereof at a rearward position from a front edge of the bucket, and at least a pair of the skid devices described above mountable or assembled to the bucket.

The bucket assembly can have a pair of the auxiliary members described above, each connectable to one of the skid devices. One of the skid devices can be mounted to the right side of the bucket and the other of the skid devices can be mounted to the left side of the bucket. The pair of auxiliary members can be configured to allow the bucket assembly to hold elongated objects that are wider than the bucket.

Another aspect of the present development is a method of forming the skid device. The method includes a first bending step, a second bending step, and a securing step. The first bending step bends a single steel plate, at a predetermined distance from one end thereof, over onto itself by about a first predetermined degree to form the angled portion, which is angled relative to the base portion that extends from the one end to the angled portion. The second bending step bends the single steel plate, at a predetermined distance from the other end thereof to form the leveled portion that is substantially parallel to the base portion. In other words, in the second step, the leveled portion is bent until it becomes substantially parallel to the base portion. The securing step secures the base portion to the upper side of the base member.

DETAILED DESCRIPTION

The present development can be applied to moving materials, such as snow, mulch, or dirt on grass, cut wood, or any similar material, with a tractor, skid-loader, or other machine that has a loader, particularly where the preservation of the underlying surface is a priority. For example, leaving the stones in a driveway when pushing snow, not damaging the grass when lifting a pile of mulch or cut wood, or avoiding damage to expansion joints on a concrete surface when clearing off dirt or snow can be achieved with the present development. Moreover, the present development can be used to lift and carry narrow items longer than the width of the bucket, such as wooden logs or posts.

The present development combines the versatility of the bucket with additional functionalities that are also economical, namely the ability to move materials with reduced risk of having the leading edge disturb the ground surface, all the while not requiring modifications to the bucket itself (i.e., maintaining the bucket itself intact). While there exists examples of quick attach pallet forks used for lifting and carrying pallet-sized objects, they can be expensive due to the required strength and length associated with lifting these loads. The present development combines an economical and convenient way moving material without ground disturbance with a simple and inexpensive way of carrying small loads that are wider than the tractor bucket.

The present drawings illustrate a skid device 20 (or EDGE TAMER coined by the present inventors) and a bucket assembly 30 comprising a bucket 10 and the skid device 20.

The bucket 10 can be any conventional or commercial bucket that is typically associated with tractors or heavy equipment machines. The bucket is typically configured to have an inner volume sufficient to hold loose materials, such as dirt, sand, rocks, and even snow. Specifically, referring to FIG. 1, the bucket 10 typically can have a bottom portion 10*a*, left and right side portions 10*b*, 10*c*, and a back portion 10*d* all integrally held together to form a rigid structure having the inner volume sufficient to hold materials. Excavator buckets can even have teeth protruding from its front or cutting edge 10*e*, and configured to disrupt material. The bucket 10 also has a connecting mechanism (not shown) for attaching to a tractor or the like. The connecting mechanism is also conventional.

Figure 1:
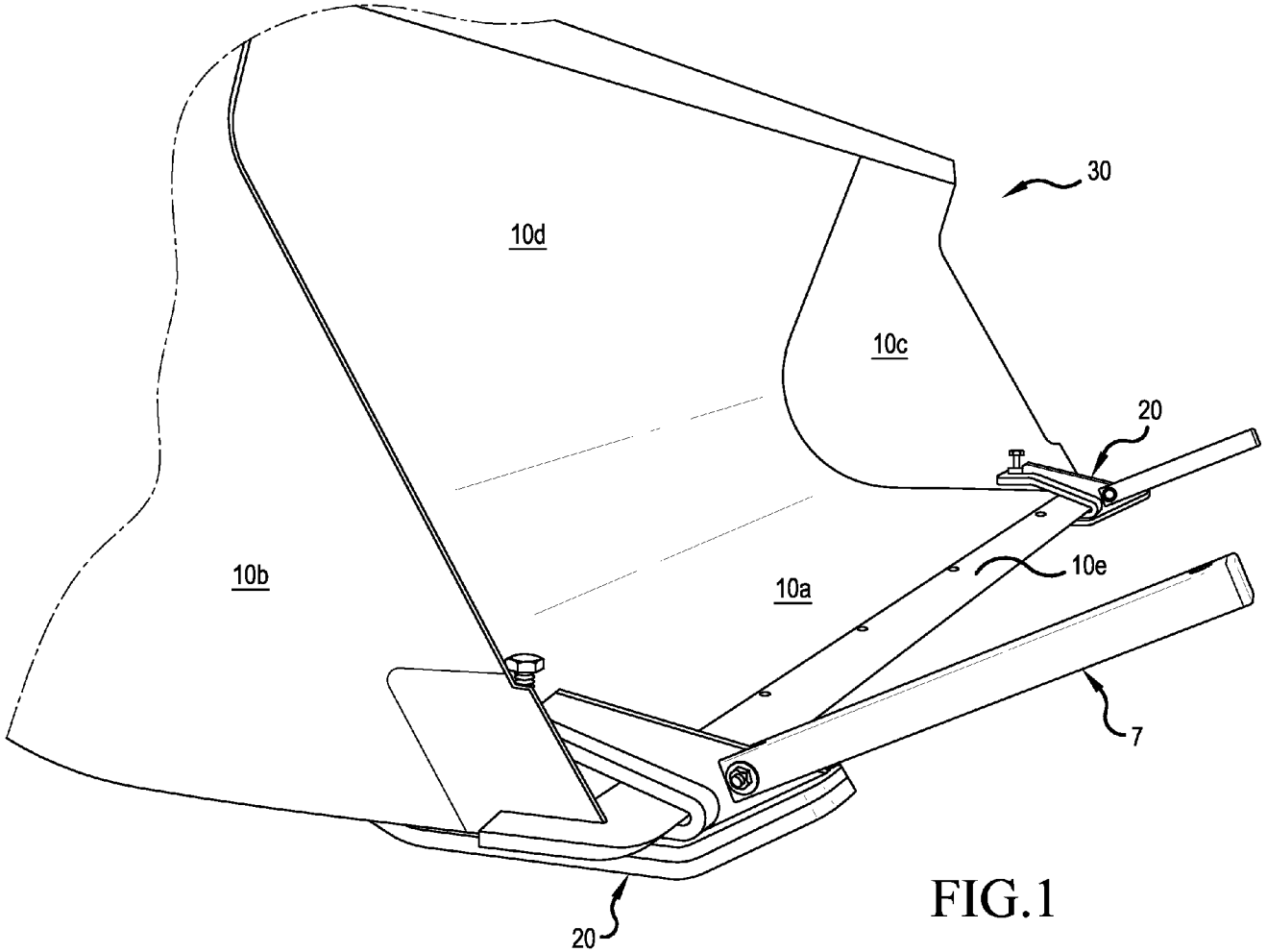
FIG. 1 illustrates a bucket assembly with two skid devices, with extension attachments, according to an embodiment of the present development attached to a conventional loader bucket.
Figure 2:
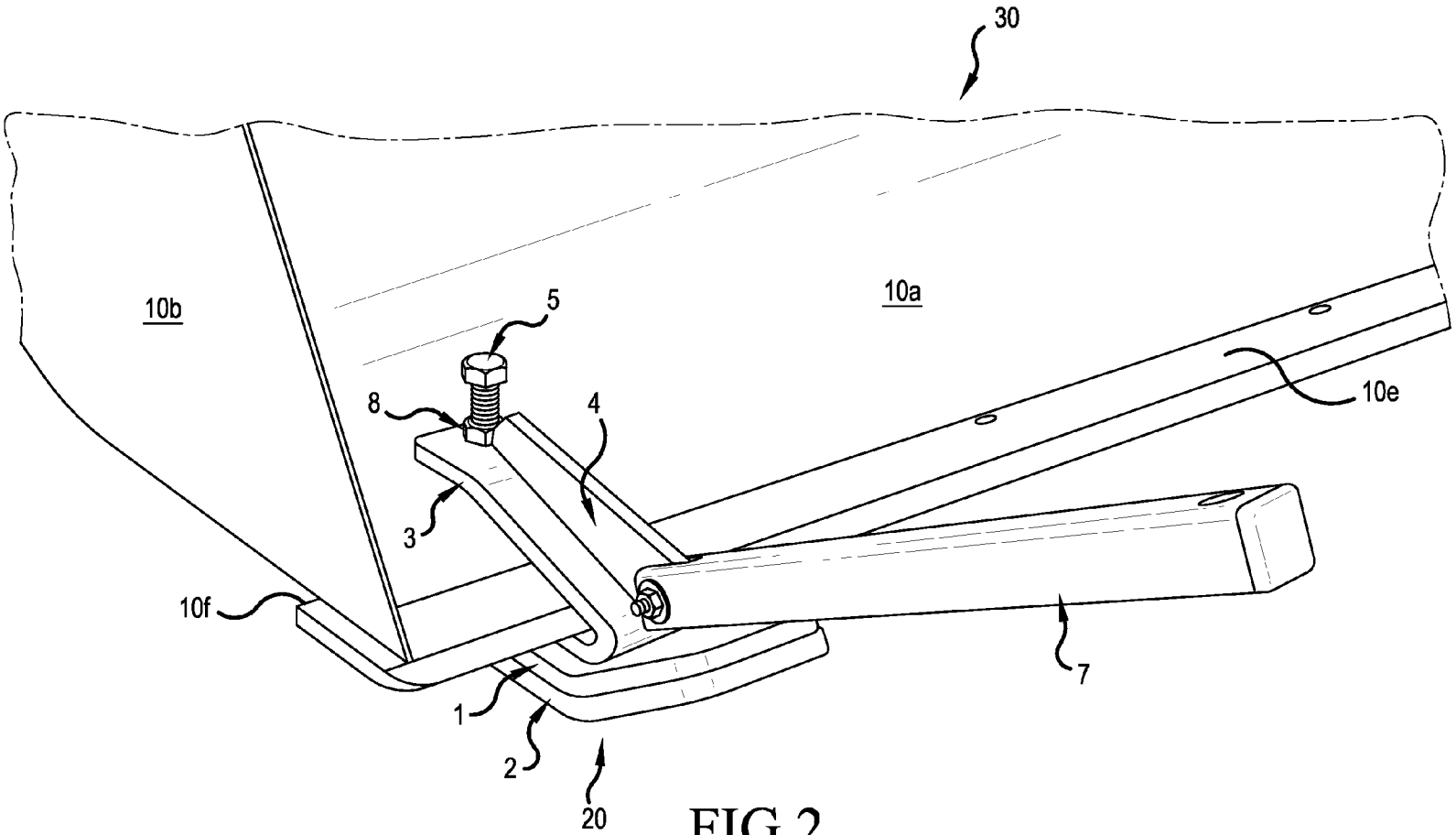
FIG. 2 illustrates another view of the present skid device, with the extension attachment, attached to a conventional loader bucket.
Figure 3:
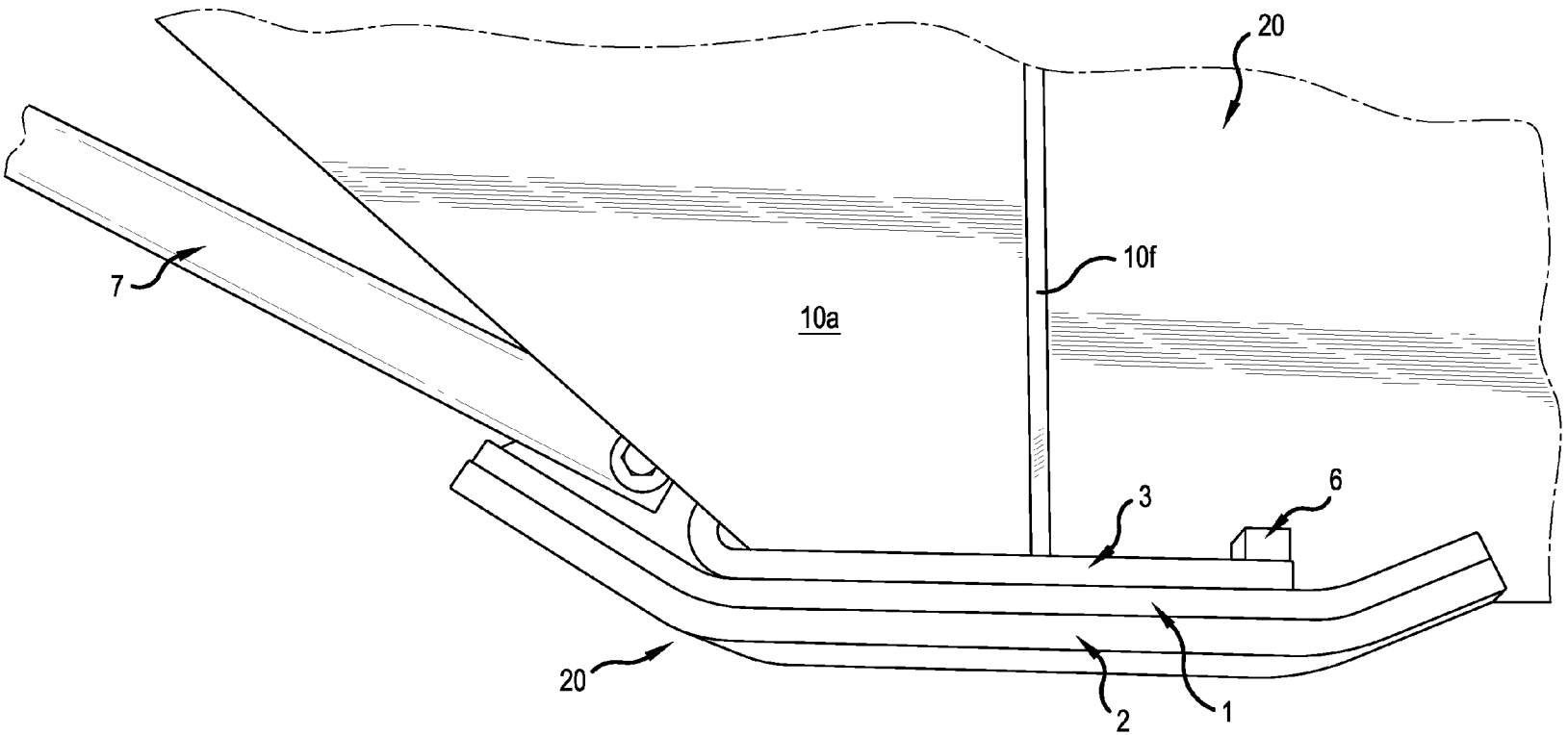
FIG. 3 illustrates yet another view of the present skid device, with the extension attachment device, attached to a conventional loader bucket.

Referring to FIGS. 1-3, the bottom portion 10*a* of the bucket can be substantially flat. The underside of the bottom portion 10*a* can have a lip portion 10*f*. Specifically, the front side of the bucket is typically made thicker for strength and durability. The thicker portion can ends abruptly or gradually, leaving an underside wall having some thickness (height) that forms the lip portion 10*f*. In other words, the underside of the bottom portion has a stepped configuration, with the distal side of the front end being raised from the proximal side of the lip portion 10*f*. The present development takes advantage of this lip portion 10*f* to prevent the skid device 20 from falling off the bucket.

The skid device 20 comprises a base member 1, a wear member 2, a mount bracket 3, a reinforcement member 4, a fastener device 5, 8, and a retainer member 6. An extension bar 7 can be attached to the skid device 20 as an auxiliary member.

Figure 4:
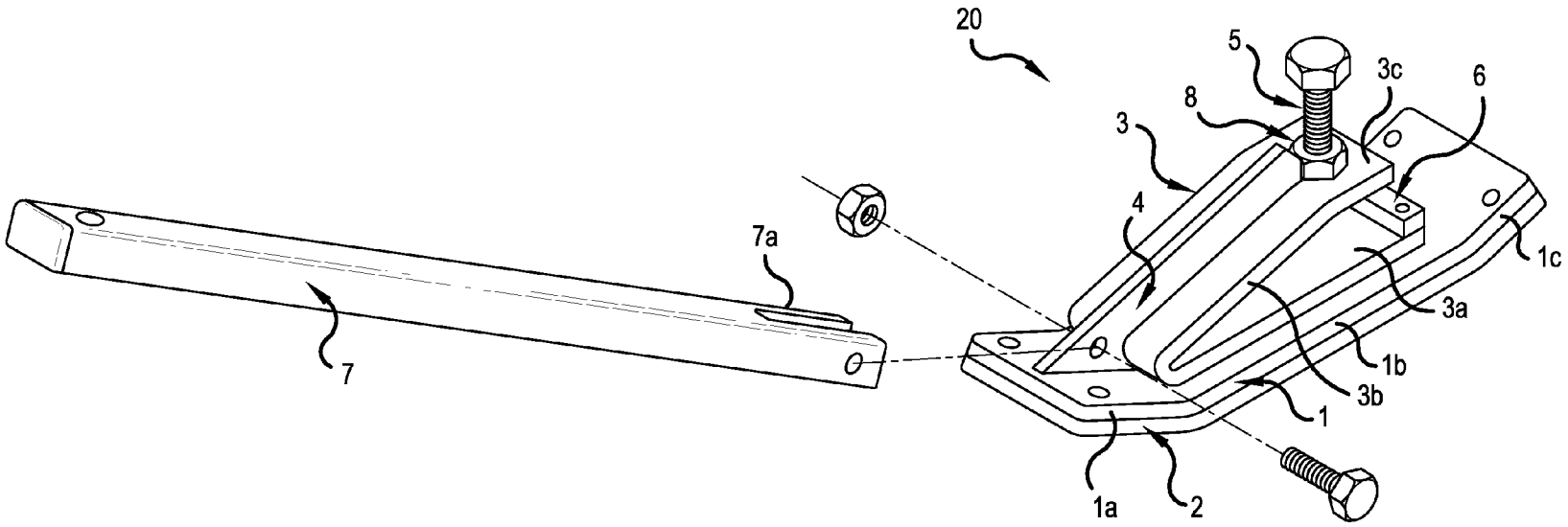
FIG. 4 illustrates the present skid device itself.
Figure 5:
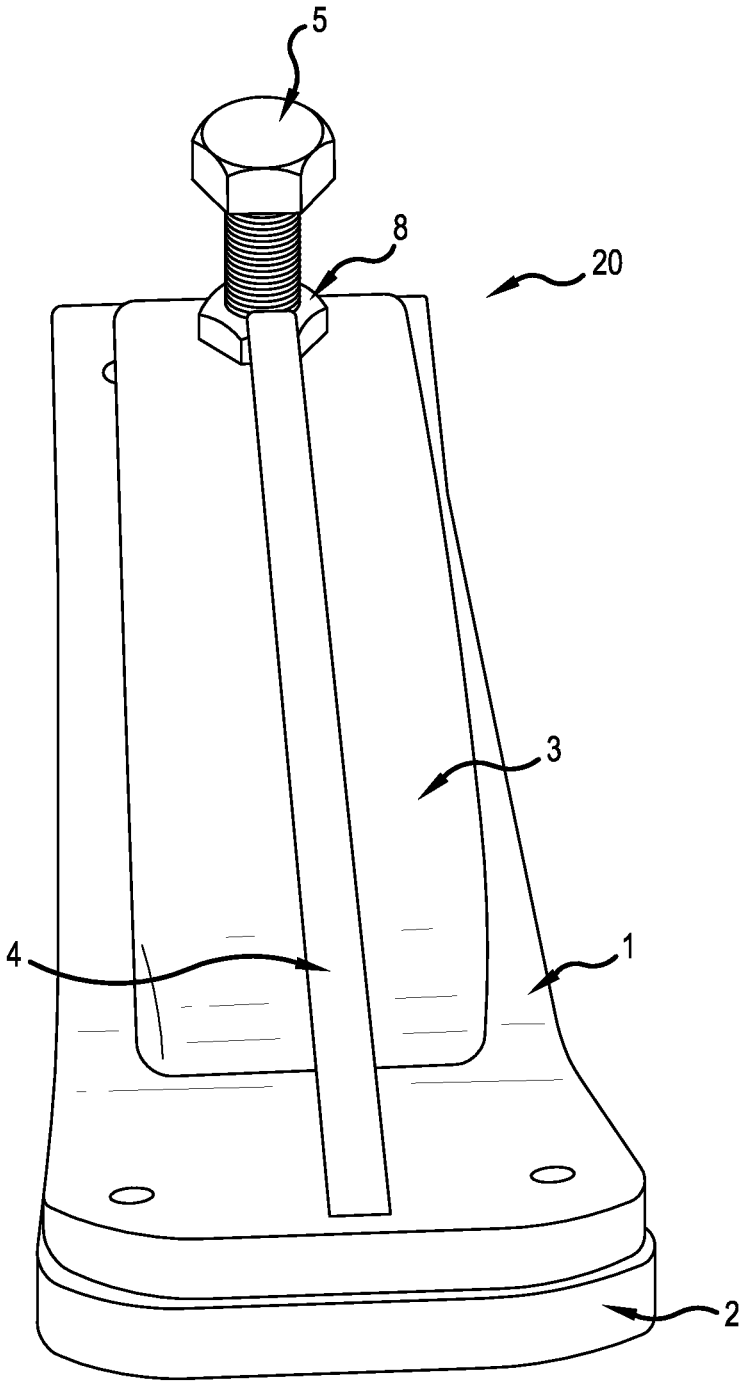
FIG. 5 illustrates another view of the skid device itself.

Referring to FIG. 4, the base member 1 is elongated in shape and can have a leading end section 1*a* (front), a middle section 1*b*. and a trailing end section 1*c* (rear). Both the leading end section 1*a* and the trailing end section 1*c* can be angled or bent at about 20 degrees, similar to the way ski tips are raised. The angle can be made different, however, depending on use (i.e., higher angle for soft ground and vise-versa for hard ground). That is, the angle can be less than or greater than 20 degrees. Moreover, the angles of the leading end section and the trailing end section can be different from each other. The middle section 1*b* is the primary load bearing area. In this respect, the middle section 1*b* is made flat or substantially flat to bear load relative to the ground.

The base member can be made from steel, namely a single steel plate, such as ⅜" thick stainless steel. The size of the base member 1 can vary according to the size of the bucket to be used. As an example, the base member 1 can be approximately 12" long and 3" wide, with both the leading end section 1*a* and the trailing end section 1*c* angled up or bent at about 20 degrees, similar to the way ski tips are raised. The above example length refers to the length before the leading and trailing end sections are angled/bent upwardly.

The wear member 2, which can be replaceable, is configured the same as (complementary to) the base member 1 and secured to the base member 1 by any conventional means, such as with screws. Alternatively, the bottom of the base member 1 can have dove-tail recesses or protrusions or the like and the upper surface of the wear member 2 can have complementary dove-tail protrusions or recesses to allow the wear member to be installed to the base member by sliding it sideways and held with an interference fit. Screws also can be used to retain the wear member from sliding sideways.

The wear member 2 can be any number of materials conventionally used for such purpose, such as ultra-high-molecular-weight polyethylene (UHMWE) or polytetrafluoroethylene (PPTFE or otherwise known as TEFLON). The wear member can be cut and form-fitted to the same shape and dimensions as the base member 1. In this respect, the wear member also can be configured to cover both lateral side edges of the base member, along the full length, for added protection.

The wear member allows the bucket to glide over sensitive surfaces, such as grass or pavement, to prevent potential staining of concrete or paved surface due to paint or rust rubbing off the bottom of the base member.

Figure 6:
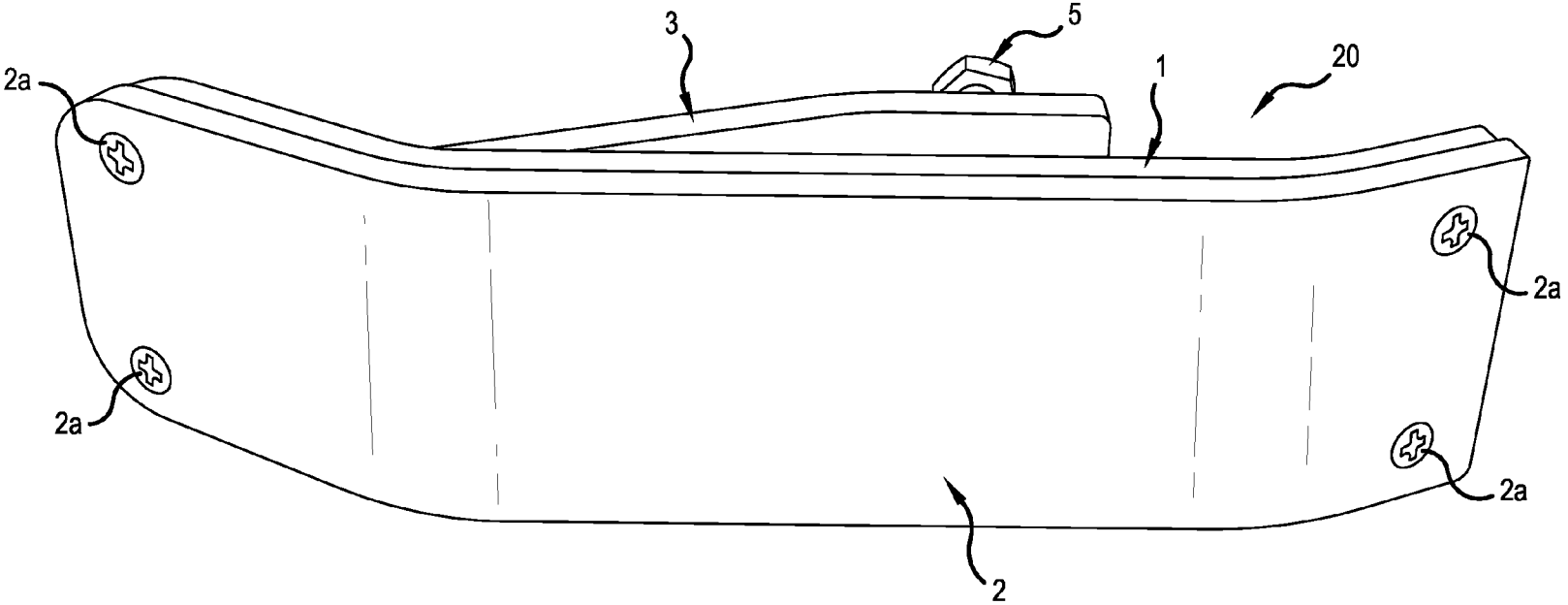
FIG. 6 illustrates another view of the skid device itself, showing the bottom surface that comes in contact with the ground.

In the illustrated embodiment (see FIG. 6), four threaded fasteners 2*a* are used to secure the complementary shaped wear member 2 to the base member 1. The fasteners 2*a* are located in the angled portions near the leading and trailing end sections. Two holes can be drilled at each end portions to accept screws to secure the wear member to the base member. Alternatively, adhesive can be used in conjunction with the fasteners for enhanced securement. The corresponding portions of the base member 1 can be threaded to accept the fasteners. Each fastener hole can be countersunk at the wear member so that the fasteners, such as stainless steel screws, can be flush with or positioned inside the wear member for added protection. Positioning the fasteners near to angled tip portion will minimize damage from the ground, enabling the removal of fasteners even if the wear member wears out.

The mount bracket 3 holds the fastener device 5, 8 for securing the skid device to the bucket 10. Specifically, the mount bracket 3 can include a base portion 3*a*, an angled portion 3*b*, and a leveled end portion 3*c*. The base portion 3*a* is secured to the upper side of the base member 1, namely on the upper side of the middle section 1*b*. The leveled end portion 3*c* can be parallel to the base portion 3*a*. For example, the mount bracket can be formed from a single steel plate, such as ⅜" thick steel plate, approximately 2" wide and 12.75" long, by bending (folding) about 150 degrees over onto itself at 6.5" from one end, and bending about another 30 degrees at 10.75" (or about 2" from the other end), so that the leveled end portion 3*c* (the final 2" portion) is made parallel to the base portion 3*a* (the 6.5" portion). This bent-over configuration is to complement the shape of the front side portion of the bucket 10. Accordingly, depending on the front side configuration of the bucket, the mount bracket can be configured differently to receive the front edge portion of the bucket. The illustrated mount bracket 3 can be described as a J-shaped or fish-hook-shaped mount shoe.

The fastener device can include a fastener 5, such as a bolt, and a fastener receiving member 8, such as a nut. The leveled end portion 3*c* can have a hole, such as ½" hole to receive a fastener receiving member 8 for holding the fastener 5. The hole can be threaded to receive the fastener 5 directly or, as illustrated, receive the fastener receiving member 8, which can be secured by welding to the leveled end portion 3*c* while aligned with the hole, to enable the fastener 5 to be tightened against the bucket to secure the skid device to the bucket. The fastener device 5, 8 serves as a primary securing device to secure the skid device to the bucket.

The entire base portion 3*a* can be welded to the middle section 1*b* (i.e., flat portion) of the base member 1 extending between the sloped ends, with the folded side situated toward the leading end (front) side of the base member 1.

Both the retainer member 6 and the base portion 3*a* can be configured to abut against the bottom side of the bucket for added security when the bolt is tightened. The retainer member 6, in addition to the base portion, serves as an additional pressure point against the bottom of the bucket when the bolt 5 is tightened down against the bucket from the opposite side. Should the fastener 8 become loose, the retainer member 6 also serves as a retainer for retaining the skid device. That is, the retainer member 6 would abut against the bucket's lip portion 10*f* and prevent the skid device 20 from falling off the bucket. See FIG. 3. Since the retainer member 6 would be loosely held (secondary securement) against the bucket's lip portion 10*f*, the skid device 20 can slide around, laterally and/or in a fore and aft direction, and rattle, alerting the operator that the skid member needs to be tightened against the bucket. The retainer member 6 thus would also serves as an alarm device when the skid member becomes loose. The retainer member 6 can be formed, for instance, from a small steel bar, such as approximately ¼" by ¼" by 2.0" wide, secured to an upper side of the trailing end of the base portion 3*a*, such as by using stainless screws or can even be welded.

The retainer member can be held by screws to allow for replacement with different retainer members having different heights to accommodate for differently configured bottom portion 10*a* of the buckets. That is, the height of the retainer member can be adjusted to allow both the retainer member 6 and the base portion 3*a* to contact the underside of the bottom portion 10*a* of the bucket and serve as pressure points (areas). The retainer member even can be spring loaded so that it is movable vertically relative to the base portion 3*a*, while still being loosely held to the base portion 3*a*, and create additional rattling noise when the bolt 8 becomes loose. Tightening the bolt 8 would press the retainer member toward the base portion 3*a* and secure it between the underside of the bottom portion of the bucket arid the upper side of the base portion 3*a*. For instance, the retainer member 6 can have a pair of holes each with a larger countersink having a sufficient depth. The retainer member can be guided with vertical rods extending through the holes, with springs placed between the retainer member 6 and the base portion 3*a*. Screws can be used to secure the vertical rods to the base portion 3*a*, while loosely securing the retainer member to allow for vertical displacement (e.g., oscillation) of the retainer member relative to the base portion 3*a* using the spring force and gravity.

The reinforcement member 4 reinforces the mount bracket 3. The reinforcement member can be formed of, for instance, at least one steel gusset, such as a ⅜" thick steel plate, configured to the shape filling the gap from the outside of the angled portion 3*b* and the angled leading end of the base member 1. This member 4 not only strengthens the skid device, it prevents excessive tightening of the fastener 5 from permanently bending the bent portion 3*b*. The reinforcement member 4 can be welded to both the mounting bracket and the base member at its front angled section 1*b*. The reinforcement member can be a pair of parallel members with cross-brace members for strengthening purposes.

At least a pair of removable auxiliary members 7 can be mounted to a pair of skid devices mounted to either sides of the bucket. The auxiliary members can serve as supports for large items that are longer than the width of the bucket.

For example, each auxiliary member 7 can be formed of steel, such as a bar having 12" long and 1" square. The auxiliary member can be connected via a bolt, or the like, extending through a hole formed in the reinforcement member and secured with a nut. In this respect, one end 7*a* of each of the auxiliary member each can have a yoke configuration that can straddle the respective reinforcement member 4. The yoke has a hole on each arm portion to permit insertion of a fastener, such as a bolt or the like. For added strength, the auxiliary members each rest on the upper surface of the angled leading end portion of the base member 1. Although the drawings illustrate the auxiliary members in a form of a bar, they need not be bar shaped. They can have any desired configuration to suit the purpose of carrying long objects.

The present development enables use of a tractor bucket to move snow, mulch, and other such materials with less disturbance of the underlying ground surface. For example, the movement of snow on a gravel driveway or the lifting of mulch or cut wood off a lawn can be achieved with the present development. Since a bucket loader has a long, flat leading edge, in operation the edge can quite easily cut into the underlying ground when trying to lift or move material. This can result in a damaged lawn, or stones being moved off the driveway while clearing snow. The present development, which has a ski-like ends, is simple to attach, without needing to modify the bucket, with a tightening of a bolt, and can feature a removable wear member for improved gliding. Moreover, due to the reinforcement member 4, the mount bracket is designed to not permanently bend during tightening.

In use, at least two skid devices would be mounted to the bucket by sliding them over the leading edge of the bucket, and by tightening each bolt so that pressure is applied against the bucket, which drives the trailing end of the base member up into the underside of the bucket, thereby locking the skid device into place. See FIG. 3. A tension is provided by the bolt on the top of the bucket and the retainer member 6 on the bottom, which provides the additional benefits of preventing the device from falling off if the fastener becomes loose, as well as alerting the operator to a loss of tension by rattling against the bottom of the bucket.

Two or more auxiliary member 7 can be attached two or more skid devices to carry items that are wider than the bucket and therefore cannot be carried inside the bucket, such as steel or wooden posts or logs longer than the width of the bucket.

Given the present disclosure, one versed in the art would appreciate that there may be other embodiments and modifications within the scope and spirit of the present development. Accordingly, all modifications attainable by one versed in the art from the present disclosure within the scope and spirit of the present development are to be included as further embodiments of the present development. The scope of the present invention accordingly is to be defined as set forth in the appended claims.

What is claimed is:

1. A skid device for a bucket having a stepped underside forming a lip portion extending across the width thereof at a rearward position from a front edge of the bucket, the skid device comprising:

a base member having an upper side and a lower side;

a mount bracket attached to the upper side;

a retainer member attached to the mount bracket; and a fastener device configured to secure the mount bracket to the bucket and function as a primary securing device, wherein the mount bracket is configured to be mounted to a front edge portion of the bucket, with the retainer member and part of the base member positioned underneath the front edge portion of the bucket, wherein the base member is configured to prevent the front edge portion of the bucket from contacting a ground surface, and wherein the retainer member is configured to:

engage the lip portion when the fastener becomes loose and function as a secondary securing device; and rattle against the underside and the lip portion of the bucket when the fastener becomes loose and function as an audio alarm.

2. The skid device according to claim 1, further comprising an auxiliary member.

3. The skid device according to claim 2, further comprising:

a wear member attached to the lower side of the base member, wherein the base member comprises a leading end section, a middle section, and a trailing end section, wherein both the leading end section and the trailing end section are angled relative to the middle section, which is substantially parallel to the underside of the front edge portion of the bucket upon securing the skid device to the bucket, and wherein the wear plate is configured complementary to a configuration of the base member to cover the leading end section, the middle section, and the trailing end section.

4. The skid device according to claim 3, wherein the mount bracket comprises:

a base portion secured to the upper side of the middle section of the base member;

an angled portion extending rearwardly from a front side of the base portion at an angle; and a leveled end portion extending rearwardly from a rear side of the angled portion and parallel to the base portion.

5. The skid device according to claim 4, wherein the mount bracket has a J-shape or fish-hook configuration.

6. The skid device according to claim 4, wherein the retainer member is removably attachable to a rear side of the base portion of the mount bracket.

7. The skid device according to claim 6, wherein both the retainer member and the base portion of the mount bracket contact the underside of the bucket and serve as pressure points.

8. The skid device according to claim 4, further comprising:

a reinforcement member attached to the angled portion of he mount bracket an the leading end section of the base member, wherein the auxiliary member is removably attachable to a front portion of the reinforcement member.

9. The skid device according to claim 8, wherein one end of the auxiliary member has a yoke configured to straddle the front portion of the reinforcement member, with a portion of the auxiliary member resting on an upper surface of the leading end portion of the base member.

10. A bucket assembly for moving material, the bucket assembly comprising:

a bucket having a stepped underside forming a lip portion extending across the width thereof at a rearward position from a front edge of the bucket; and at least a pair of skid devices each comprising:

a base member having an upper side and a lower side;

a mount bracket attached to the upper side;

a retainer member attached to the mount bracket; and a fastener device configured to secure the mount bracket to the bucket and function as a primary securing device, wherein the mount bracket is configured to be mounted to a front edge portion of the bucket, with the retainer member and part of the base member positioned underneath the front edge portion of the bucket, wherein the base member is configured to prevent the front edge portion of the bucket from contacting a ground surface, and wherein the retainer member is configured to:

engage the lip portion when the fastener becomes loose and function as a secondary securing device; and rattle against the underside and the lip portion of the bucket when the fastener becomes loose and function as an audio alarm.

11. The bucket assembly according to claim 10, further comprising a pair of auxiliary members, each connectable to one of the skid devices.

12. The bucket assembly according to claim 11, further comprising:

a wear member attached to the lower side of the base member, wherein the base member comprises a leading end section, a middle section, and a trailing end section, wherein both the leading end section and the trailing end section are angled relative to the middle section, which is substantially parallel to the underside of the front edge portion of the bucket upon securing the skid device to the bucket, and wherein the wear plate is configured complementary to a configuration of the base member to cover the leading end section, the middle section, and the trailing end section.

13. The bucket assembly according to claim 12, wherein the mount bracket comprises:

a base portion secured to the upper side of the middle section of the base member;

an angled portion extending rearwardly from a front side of the base portion at an angle; and a leveled end portion extending rearwardly from a rear side of the angled portion and parallel to the base portion.

14. The bucket assembly according to claim 13, wherein the mount bracket has a J-shape or fish-hook configuration.

15. The bucket assembly according to claim 13, wherein the retainer member is removably attachable to a rear side of the base portion of the mount bracket.

16. The bucket assembly according to claim 15, wherein both the retainer member and the base portion of the mount bracket contact the underside of the bucket and serve as pressure points.

17. The bucket assembly according to claim 13, further comprising:

a reinforcement member attached to the angled portion of the mount bracket and the leading end section of the base member, wherein the auxiliary member is removably attachable to a front portion of the reinforcement member.

18. The bucket assembly according to claim 17, wherein one end of the auxiliary member has a yoke configured to straddle the front portion of the reinforcement member, with a portion of the auxiliary member resting on an upper surface of the leading end portion of the base member.

19. The bucket assembly according to claim 11, wherein:

one of the skid devices is mounted to a right side of the bucket and the other of the skid devices is mounted to a left side of the bucket, and the pair of auxiliary rods are configured to allow the bucket assembly to hold elongated objects that are wider than the bucket.

20. A method of forming a skid device for a bucket having a stepped underside forming a lip portion extending across the width thereof at a rearward position from a front edge of the bucket, wherein the skid device comprises:

a base member having an upper side and a lower side;

a mount bracket attached to the upper side;

a retainer member attached to the mount bracket; and a fastener device configured to secure the mount bracket to the bucket and function as a primary securing device, wherein the mount bracket is configured to be mounted to a front edge portion of the bucket, with the retainer member and part of the base member positioned underneath the front edge portion of the bucket, wherein the base member is configured to prevent the front edge portion of the bucket from contacting a ground surface, and wherein the retainer member is configured to:

engage the lip portion when the fastener becomes loose and function as a secondary securing device; and rattle against the underside and the lip portion of the bucket when the fastener becomes loose and function as an audio alarm, and wherein the method comprises:

a first bending step of bending a single steel plate, at a predetermined distance from one end thereof, over onto itself by about a predetermined degree to form an angled portion that is angled relative to a base portion that extends from the one end to the angled portion;

a second bending step of bending the single steel plate, at a predetermined distance from the other end thereof, to form a leveled portion that is parallel to the base portion;

a securing step of securing the base portion to the upper side of the base member, wherein the mount bracket comprises the base portion, the angled portion, and the leveled portion.

* * * * *